US008771152B1

(12) United States Patent
Silverman et al.

(10) Patent No.: US 8,771,152 B1
(45) Date of Patent: Jul. 8, 2014

(54) FITNESS BAG AND METHODS OF USE

(76) Inventors: Frank B. Silverman, Orlando, FL (US); Michael J. Metzger, Orlando, FL (US)

( * ) Notice: Subject to any disclaimer, the term of this patent is extended or adjusted under 35 U.S.C. 154(b) by 274 days.

(21) Appl. No.: 13/311,061

(22) Filed: Dec. 5, 2011

Related U.S. Application Data

(60) Provisional application No. 61/419,270, filed on Dec. 3, 2010.

(51) Int. Cl.
*A63B 69/26* (2006.01)

(52) U.S. Cl.
USPC ..... 482/88

(58) Field of Classification Search
USPC ..... 482/83, 86, 87, 89, 90, 88; 273/55; 272/77; 473/444
See application file for complete search history.

(56) References Cited

U.S. PATENT DOCUMENTS

| | | | | |
|---|---|---|---|---|
| 2,203,259 | A | 3/1939 | Gilman | |
| 2,237,599 | A | 4/1941 | Gilman | |
| 2,586,283 | A * | 2/1952 | Wynn | 473/444 |
| 3,111,317 | A | 11/1963 | Cituk | |
| 3,384,372 | A | 5/1968 | Dickens | |
| 3,396,969 | A | 8/1968 | Rosenfeld | |
| 3,680,861 | A | 8/1972 | Schmidt | |
| 4,491,315 | A | 1/1985 | Dye | |
| 5,328,425 | A | 7/1994 | Knighton et al. | |
| 6,872,171 | B2 | 3/2005 | Haselrig | |
| 7,056,238 | B1 | 6/2006 | Brown | |
| 2005/0187075 | A1 | 8/2005 | Bellamy | |
| 2006/0100067 | A1 | 5/2006 | Washburn et al. | |
| 2008/0188360 | A1 * | 8/2008 | Chu | 482/83 |
| 2009/0163329 | A1 | 6/2009 | Pearce | |

FOREIGN PATENT DOCUMENTS

| | | |
|---|---|---|
| GB | WO94/28981 | 12/1994 |
| GB | 2437259 | 10/2007 |

* cited by examiner

*Primary Examiner* — Loan H Thanh
*Assistant Examiner* — Gary D Urbiel Goldner
(74) *Attorney, Agent, or Firm* — Allen, Dyer et al.

(57) ABSTRACT

A fitness bag of the invention includes a body that is elongated along an axis and has a generally circumferential surface, a first axial end surface, and a second axial end surface opposite the first axial end surface. The generally circumferential surface preferably has a radially constricted section between first and second radially enlarged sections. The first radially enlarged section is located between the radially constricted section and the first axial end surface while the second radially enlarged section is located between the first radially constricted section and the second axial end surface. A plurality of side handles may be arranged in radially opposed pairs along the body and oriented such that the ends of each handle extend towards the first and second axial end surfaces. The fitness bag is adapted to be placed both horizontally and vertically on the ground and struck by an appendage of the user.

7 Claims, 2 Drawing Sheets

FITNESS BAG AND METHODS OF USE

CROSS-REFERENCE TO RELATED APPLICATION

This application claims the benefit of co-pending provisional application Ser. No. 61/419,270 which was filed on Dec. 3, 2010 and is titled Fitness Bag and Methods of Use, the contents of which are incorporated herein by reference in their entirety.

FIELD OF THE INVENTION

The present invention relates to fitness bags, such as punching bags and dummies, and to fitness methods involving the use of such bags.

BACKGROUND OF THE INVENTION

Fitness bags are frequently used for training purposes and general physical fitness. Typically, such bags are repetitively struck—for instance, punched and/or kicked—as part of a training or exercise regime. Although conventional fitness bags are useful tools, further improvements are possible.

SUMMARY OF THE INVENTION

In view of the foregoing, it is an object of the present invention to provide an improved fitness bag. A fitness bag in accordance with an embodiment of the invention includes a body that is elongated along an axis and has a generally circumferential surface, a first axial end surface, and a second axial end surface opposite the first axial end surface. The generally circumferential surface preferably has a radially constricted section between first and second radially enlarged sections. The first radially enlarged section is located between the radially constricted section and the first axial end surface while the second radially enlarged section is located between the first radially constricted section and the second axial end surface. A plurality of side handles may be arranged in radially opposed pairs along the body and oriented such that the ends of each handle extend towards the first and second axial end surfaces. Advantageously, the fitness bag is adapted to be placed both horizontally and vertically on the ground and struck by an appendage of the user.

These and other objects, aspects and advantages of the present invention will be better appreciated in view of the drawing and following detailed description of preferred embodiments.

DETAILED DESCRIPTION OF PREFERRED EMBODIMENTS

Figure 1:
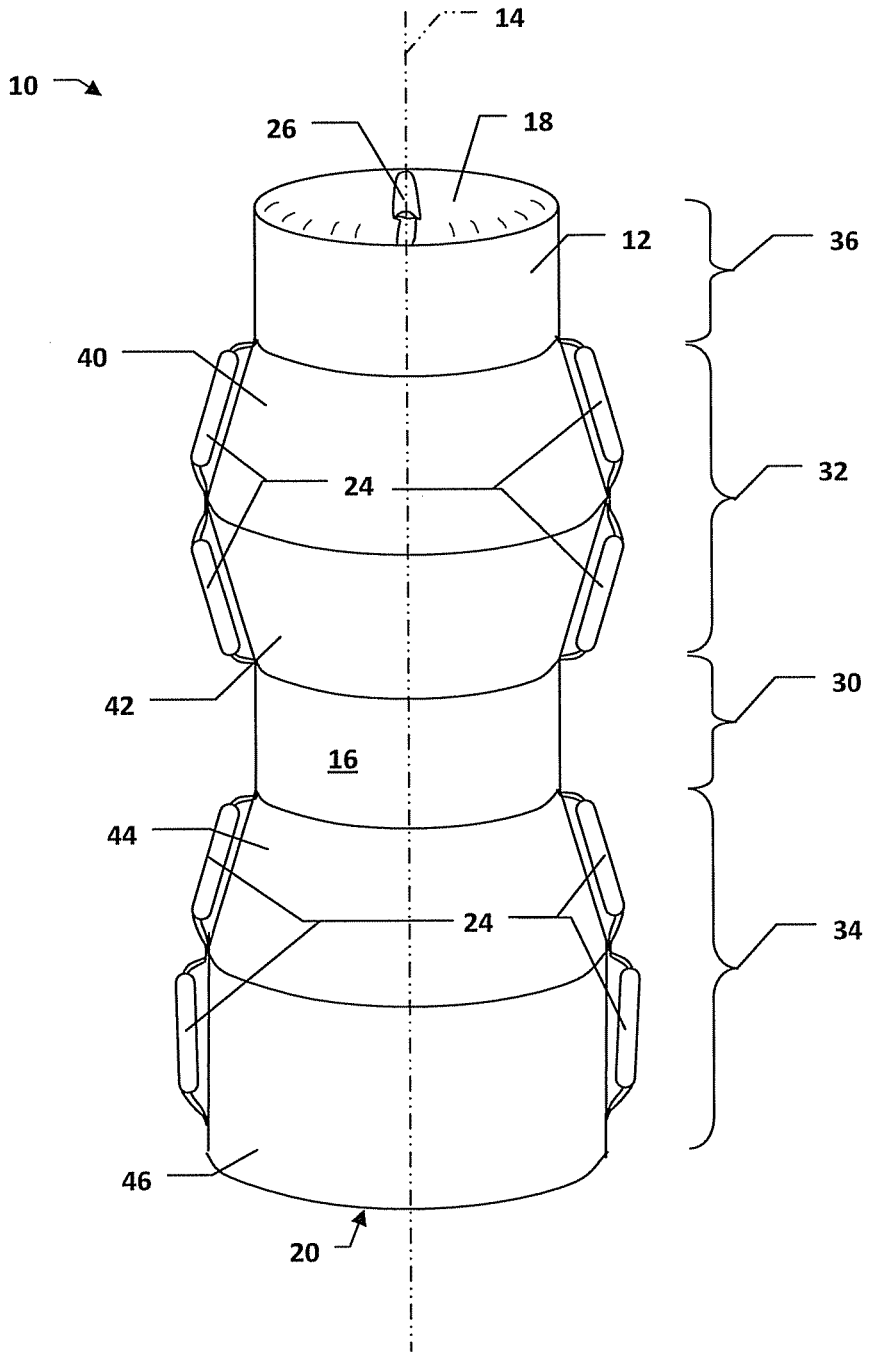
FIG. 1 is perspective view of a fitness bag according to an embodiment of the present invention.

Referring to FIG. 1, according to an embodiment of the present invention, a fitness bag 10 includes a body 12 that is elongated along an axis 14. The body 12 includes a generally circumferential surface 16 and first and second axial end surfaces 18, 20. The bag 10 further includes a plurality of side handles 24 secured to the circumferential surface 16, and preferably includes an end handle 26 on the first axial end surface 18.

As used herein, a "fitness bag" refers generically to a filled casing suitable for use in connection with fitness activities, and does not necessarily imply a specific form. For example, a "grappling dummy" is a type of "bag," as that term should be understood herein, although the present invention is not necessarily limited thereto. Moreover, the term "fitness" as used herein, is not necessarily limited to general physical fitness, but can also include fitness or skill relative to various activities. For instance, a "fitness" method involving the use of a fitness bag of the present invention can encompass martial arts training, as well as to general exercise.

In the axial direction, the generally circumferential surface 16 is preferably divided into a first radially constricted section 30 between first and second radially enlarged sections 32, 34. A second radially constricted section 36 can be included above the first radially enlarged section 32.

The first and second radially constricted sections 30, 36 are preferably generally cylindrical. The first radially enlarged section 32 preferably includes first and second generally frusto-conical portions 40, 42, such that the first portion 40 gradually slopes radially outwards from the second radially constricted section 36 and the second portion 42 gradually slopes radially outwards from the first radially constricted section. The second radially enlarged section 34 preferably includes a generally frusto-conical portion 44 and a generally cylindrical portion 46, with the frusto-conical portion gradually sloping radially outward from the second radially constricted section 30.

The plurality of side handles 24 are preferably oriented in a generally axial direction, with the ends of a given handle 24 generally extending toward opposite axial end surfaces 18, 20. The plurality of side handles 24 are also preferably arranged in generally radially opposed pairs. There are at least two pairs of side handles 24, and more preferably four pairs of side handles 24. The side handles 24 are preferably arranged on the first and second radially enlarged sections 32, 34.

In the depicted embodiment, the first and second generally frusto-conical portions 40, 42 of the first radially enlarged section 32 and the generally frusto-conical portion 44 and generally cylindrical portion 46 of the second radially enlarged section 34 each includes a respective generally radially opposed pair of side handles 24, with the handles 24 on each side of the body 12 being generally aligned in the axial direction.

Figure 2:
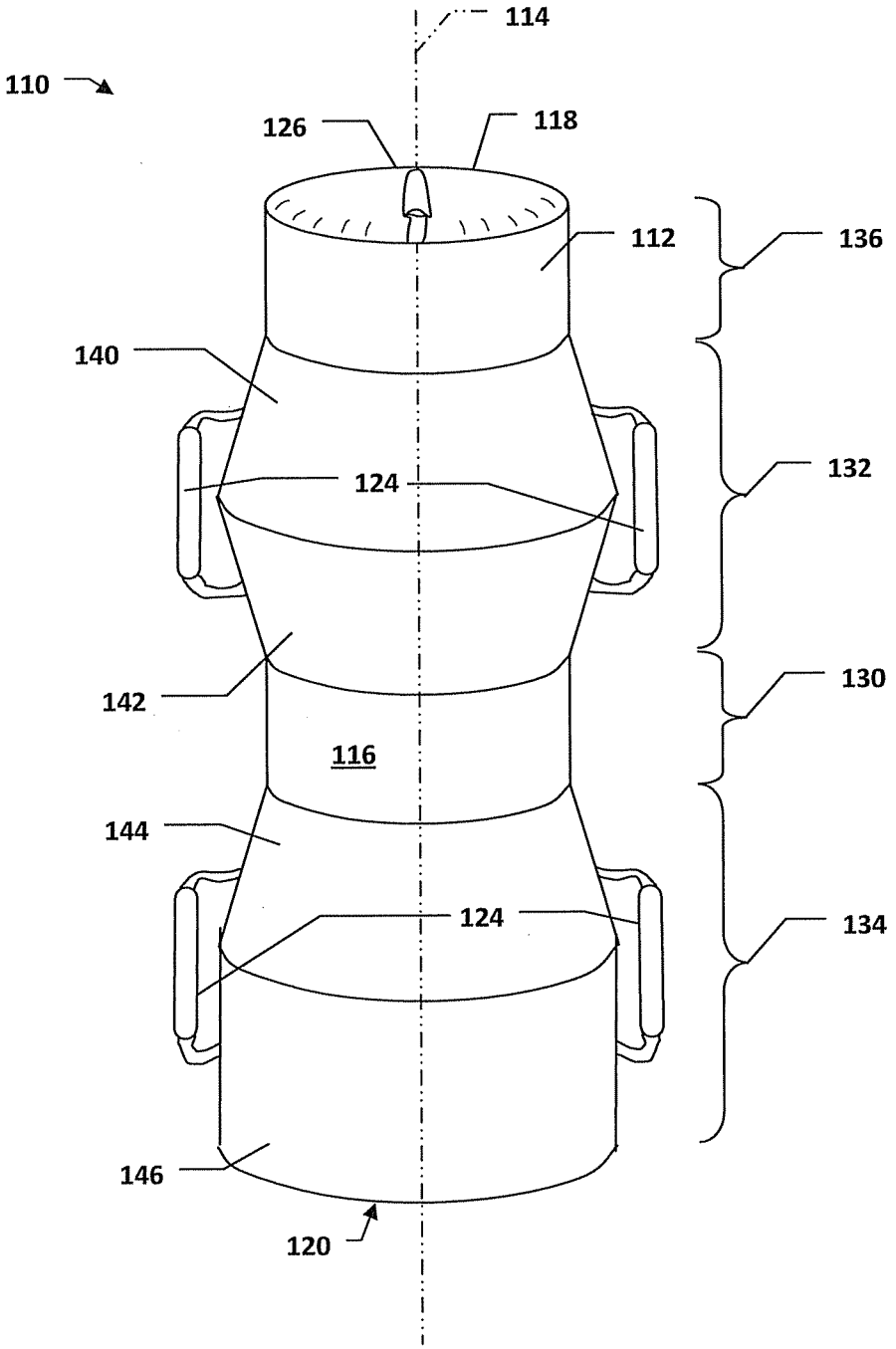
FIG. 2 is a perspective view of fitness bag according to another embodiment of the present invention.

Other side handle configurations are possible within the scope of the present invention. For example, referring to FIG. 2, a fitness bag 110 has only two generally radially opposed pairs of side handles 124. Each of the pair side handles 124 on the first radially enlarged section 132 extends from the first generally frusto-conical portions 140 to the second generally frusto-conical portions 142, and each of the pair of side handles 124 on the second radially enlarged section 34 extends from the generally frusto-conical portion 144 to the generally cylindrical portion 146. In the embodiment of FIG. 2, elements analogous to elements from the embodiment of FIG. 1 have similar reference numbers, prefaced by the number "1", with specific elements being discussed as necessary to illustrate differences therebetween.

In a method of using a fitness bag, according to the present invention, the bag is repeatedly engaged by a user during a fitness and/or training routine. Advantageously, the fitness routine is broken in a plurality of rounds, with each round being broken into a plurality of exercises. Preferably, there are five rounds each having a duration of approximately 5 minutes, with an approximately one minute break in between adjacent rounds. The rounds preferably include at least one of: a warm-up round, an upper-body round, a lower-body round, a combination round, and a cool-down round.

There are preferably approximately seven to ten exercises in each round, with each exercise having a duration of approximately 45 to 30 seconds. Advantageously, the exercises can include one or more of: exercises holding the bag 10 by one or more of the handles 24, 26 and at least partially elevating the bag 10; exercises holding the bag 10 by one or more of the handles 24, 26 and striking the bag with the extremities, including hands, feet, elbows and knees; exercises holding the bag 10 by one or more of the handles 24, 26 and moving around the bag; exercises in which the bag 10 is used as a prop or support; and exercises combining one or more of the above, for instance, an exercise in which the bag is knelt upon and struck with the hands and/or elbows.

From the foregoing, it will be appreciated that the present invention allows a greater range of uses for a fitness bag, increasing both the effectiveness and diversity of fitness and/or training routines employing a fitness bag.

In general, the foregoing description is provided for exemplary and illustrative purposes; the present invention is not necessarily limited thereto. Rather, those skilled in the art will appreciate that additional modifications, as well as adaptations for particular circumstances, will fall within the scope of the invention as herein shown and described.

That which is claimed is:

1. A fitness bag comprising:

a body elongated along an axis and having a generally circumferential surface, a first axial end surface, and a second axial end surface opposite the first axial end surface;

the generally circumferential surface having a first radially constricted section between a first and a second radially enlarged section and a second radially constricted section between the first radially enlarged section and the first axial end surface;

the first radially enlarged section including first and second generally frustoconical portions, the first generally frusto-conical portion sloping radially outwards from the second radially constricted section and the second generally frusto-conical portion sloping radially outwards from the first radially constricted section;

the second radially enlarged section being between the first radially constricted section and the second axial end surface and including a third generally frusto-conical portion and a generally cylindrical radially enlarged portion, the third generally frustoconical portion sloping radially outwards from the first radially constricted section towards the generally cylindrical radially enlarged portion, the generally cylindrical radially enlarged portion being between the third frusto-conical portion and the second axial end surface; and a plurality of side handles arranged in radially opposed pairs along the body and oriented such that the ends of each handle extend towards the first and second axial end surfaces wherein a first radially opposed pair of side handles is located on the first radially enlarged section and a second radially opposed pair of side handles is located on the second radially enlarged section.

2. The fitness bag of claim 1, further comprising a handle on the first axial end surface.

3. The fitness bag of claim 1, wherein the first and second generally frusto-conical portions meet to form a symmetric frusto-conical pair radially enlarged at a center of the symmetric frusto-conical pair.

4. The fitness bag of claim 3, wherein the diameter of the generally cylindrical portion is approximately the same as the diameter at the center of the symmetric frustoconical pair.

5. The fitness bag of claim 1, wherein the first radially opposed pair of side handles is located on the first generally frusto-conical portion, a third radially opposed pair of side handles is located on the second generally frusto-conical portion, the second radially opposed pair of side handles is located on the third generally frusto-conical portion, and a fourth radially opposed pair of side handles is located on the generally cylindrical radially enlarged portion.

6. A portable fitness bag adapted to be shifted from one position to another by a user, the fitness bag comprising:

a body elongated along an axis and having a generally circumferential surface, a first axial end surface, and a second axial end surface opposite the first axial end surface;

the generally circumferential surface having a radially constricted section between first and second radially enlarged sections;

the first radially enlarged section being between the radially constricted section and the first axial end surface;

the second radially enlarged section being between the radially constricted section and the second axial end surface;

a plurality of side handles arranged in radially opposed pairs along the body and oriented such that the ends of each handle extend towards the first and second axial end surfaces, wherein:

the fitness bag is adapted to be placed both horizontally and vertically on the ground and struck by an appendage of the user and a first radially opposed pair of side handles is located on the first radially enlarged section, a second radially opposed pair of side handles is located on the second radially enlarged section, and wherein the side handles along a given side are aligned lengthwise and along the axis.

7. The fitness bag of claim 6, wherein the first and a third pair of radially opposed side handles are located on the first radially enlarged section, the second and a fourth pair of radially opposed side handles are located on the second radially enlarged section, and wherein the side handles along a given side are aligned lengthwise and along the axis.

* * * * *